United States Patent [19]

Hulsman et al.

[11] Patent Number: 5,024,241

[45] Date of Patent: Jun. 18, 1991

[54] METHOD AND APPARATUS FOR MANUFACTURING A ROD OF TOBACCO OR THE LIKE ENCLOSED BY A PAPER STRIP, AND CIGARETTE MANUFACTURED BY SAID METHOD

[75] Inventors: Severien Hulsman, Doesburg; Johannes H. A. G. Salemink, Aerdt, both of Netherlands

[73] Assignee: Turmac Tobacco Company B.V., Zevenaar, Netherlands

[21] Appl. No.: 483,354

[22] Filed: Feb. 22, 1990

[30] Foreign Application Priority Data

Mar. 31, 1989 [NL] Netherlands ..... 8900787

[51] Int. Cl.[5] ..... A24C 5/18; A24C 5/10; A24D 1/02

[52] U.S. Cl. ..... 131/84.2; 131/84.1; 131/80; 131/360; 131/365; 131/64.2

[58] Field of Search ..... 131/64.1, 64.2, 84.1, 131/84.2, 360, 365, 79, 80

[56] References Cited

U.S. PATENT DOCUMENTS

| | | | |
|---|---|---|---|
| 1,282,779 | 10/1918 | Dula | 131/64.1 |
| 1,949,654 | 3/1934 | Norris | 131/64.2 |
| 3,624,722 | 11/1971 | Stone | 131/84.1 |
| 3,863,644 | 2/1975 | Hunt | 131/336 |
| 4,480,644 | 11/1984 | Luke | 131/84.1 |
| 4,917,118 | 4/1990 | Mangiarotti | 131/84.1 |

FOREIGN PATENT DOCUMENTS

| | | | |
|---|---|---|---|
| 2250984 | 5/1973 | Fed. Rep. of Germany | 131/336 |
| 2836030 | 3/1979 | Fed. Rep. of Germany | 131/84.1 |
| 3435844 | 4/1985 | Fed. Rep. of Germany . | |
| 3435845 | 4/1985 | Fed. Rep. of Germany . | |
| 1349992 | 4/1964 | France . | |
| 173017 | 10/1972 | Netherlands . | |

*Primary Examiner*—V. Millin
*Assistant Examiner*—Lynne A. Reichard
*Attorney, Agent, or Firm*—Lorusso & Loud

[57] ABSTRACT

A method and apparatus for manufacturing a rod of tobacco or the like enclosed by a paper strip is described, wherein a paper strip is supported and transported by a garniture tape and tobacco is deposited on the paper strip. The tobacco is compressed into a tobacco core and the paper strip is closed with its longitudinal edges parts around the compressed tobacco core. A channel is formed in the circumference of the tobacco rod during the compressing by means of an entrance finger with a ridge. A second longitudinal edge part of the paper strip is folded into the channel by a folding element and a first longitudinal edge part is subsequently laid over said channel.

15 Claims, 3 Drawing Sheets

METHOD AND APPARATUS FOR MANUFACTURING A ROD OF TOBACCO OR THE LIKE ENCLOSED BY A PAPER STRIP, AND CIGARETTE MANUFACTURED BY SAID METHOD

BACKGROUND OF THE INVENTION

The invention relates to a method and apparatus for manufacturing a rod of tobacco or the like enclosed by a paper strip, wherein a paper strip is supported and transported by a garniture tape and tobacco is deposited on the paper strip, wherein the tobacco is compressed into a tobacco core and a channel is formed in the tobacco core and wherein the paper strip is closed with its longitudinal edges parts around the compressed tobacco core, and to a cigarette manufactured in accordance with said method.

A cigarette with a channel at the circumference of the cigarette is for example known from Dutch patent 173.017 and French patent 1.349.992. These documents only indicate that there is such a channel in the tobacco rod, wherein it is noted in said first document that the cigarette can be manufactured by an adapted cigarette machine. However, it is not indicated which adaptations are required. Further German "Offenlegungsschriften" 3.435.844 and 3.435.845 describe relatively complicated special cigarette machines for manufacturing a tobacco rod with a central core with low density.

A first object of the invention is to provide a method of the above-mentioned type for forming an open channel at the circumference of the tobacco rod in a relatively simple manner.

A second object of the invention is to provide an apparatus, by which it is possible to apply the method according to the invention by minor technical adaptations on existing cigarette machines.

A further object of the invention is to provide a cigarette manufactured by the method according to the invention.

SUMMARY OF THE INVENTION

To this end the method of the above-mentioned type according to the invention is characterized in that the channel is formed in the circumference of the tobacco rod during the compressing, and in that the second longitudinal edge part of the paper strip is folded into the channel and the first longitudinal edge part is subsequently laid over said channel.

In this manner the desired channel is directly recessed in the circumference of the tobacco core wherein the form of the channel obtained is fixed by folding the longitudinal edge part of the paper strip into this channel. Thereby it is not necessary to use separate manufacturing steps for forming tubes or the like. Moreover it is possible to obtain a good filling with tobacco also at the location of the channel so that a uniform density along the whole cross-section can be guaranteed.

According to the invention the second longitudinal edge part is preferably brought into the shape of said channel before it is folded into said channel. By preshaping the longitudinal edge part of the paper strip any damages of the tobacco core at the location of the channel during introducing the paper into the channel, are avoided as much as possible.

According to a favourable embodiment the first longitudinal edge part of the paper strip is attached to the second longitudinal edge part at both sides of said channel, wherein a folding element protrudes in the formed channel during said attaching. In this manner a channel open along the whole length of the tobacco rod is guaranteed, wherein a permanent shape stability is guaranteed due to the attachment of the first longitudinal edge part on both sides of the channel.

An apparatus for manufacturing a rod of tobacco or the like enclosed by a strip of paper, comprising an endless garniture tape with a tape part for supporting the paper strip, a supporting body with a guiding trough for guiding said tape part of the garniture tape, said guiding trough having a mainly semi-cylindrical cross-section and an entrance end and exit end, respectively, an entrance finger located near the entrance end of the guiding trough for compressing the supplied tobacco, a first glueing means for applying a glue line on the end edge of a first longitudinal edge part of said paper strip and means for closing the paper strip around the compressed tobacco core, is characterized according to the invention in that said entrance finger is provided with a ridge for forming a channel in the circumference of the tobacco core, wherein said closing means include a folding element for folding a second longitudinal edge part of the paper strip into said channel.

A cigarette according to the invention comprises a tobacco rod with a channel in its circumference, wherein one longitudinal edge part of the paper strip is folded into the channel and the other longitudinal edge part extends over this channel and is attached to said one longitudinal edge part on both sides of said channel.

SHORT DESCRIPTION OF THE DRAWINGS

The invention will be further explained by reference to the drawings in which an embodiment of the apparatus according to the invention is schematically shown.

FIGS. 1 and 2 schematically show an embodiment of the apparatus according to the invention in top and side views, respectively.

DETAILED DESCRIPTION OF A PREFERRED EMBODIMENT

Figure 1:
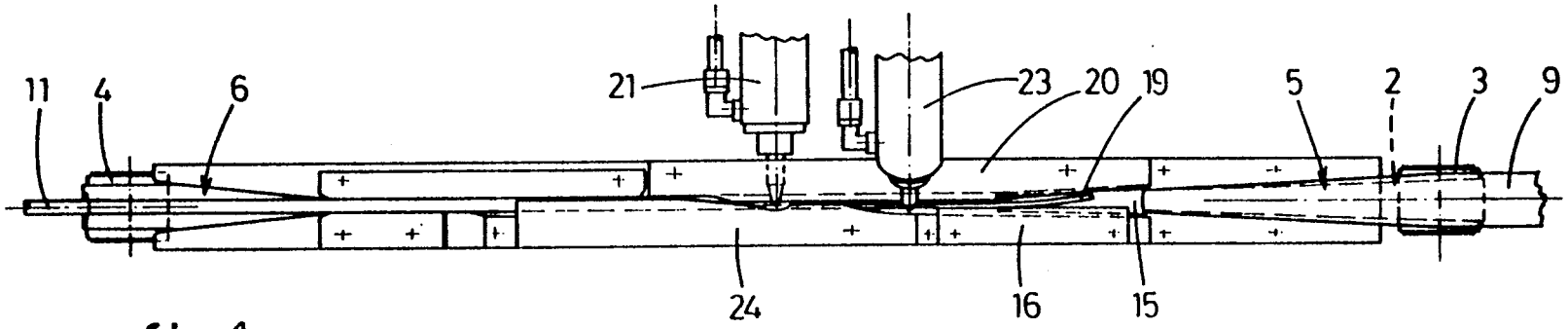
Figure 2:
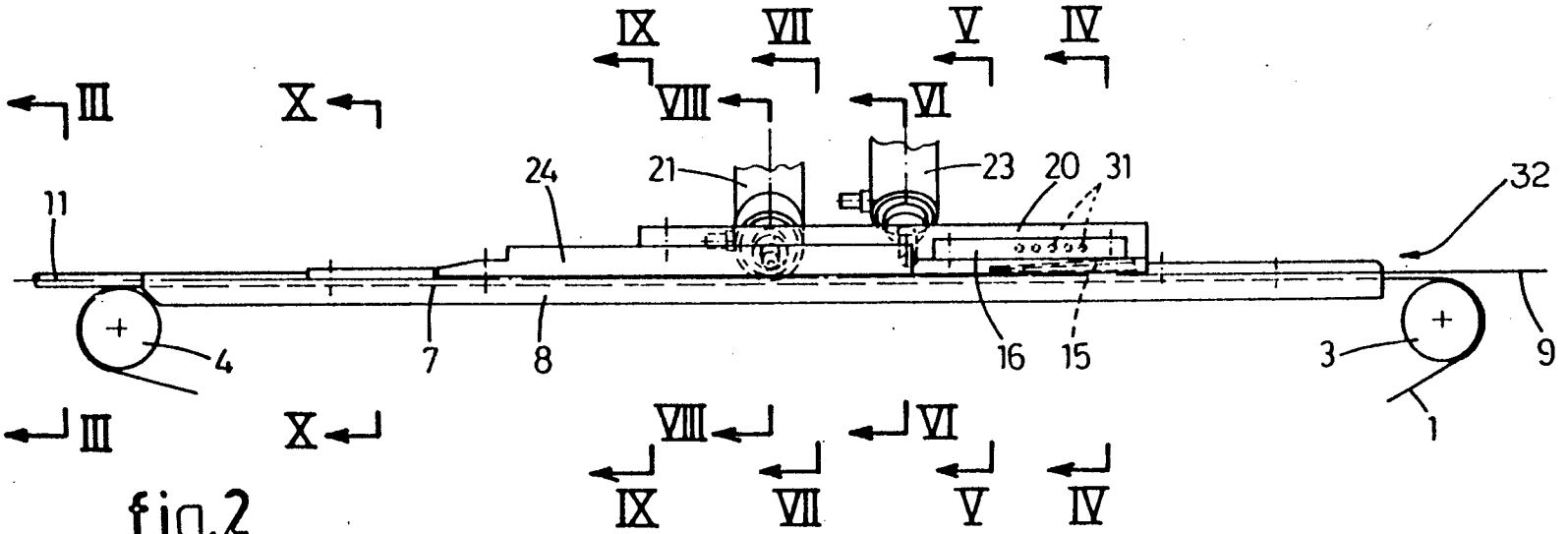

FIGS. 1 and 2 very schematically show an embodiment of the apparatus according to the invention as the same can be included in a conventional cigarette machine. The apparatus shown is provided with an endless garniture tape 1, of which only an upper horizontal tape part 2 is indicated by a dashed line in FIGS. 1 and 2. This tape part 2 extends between two return rollers 3 and 4 located at an entrance end 5 and an exit end 6, respectively, of a guiding trough 7 having a mainly semi-cylindrical cross-section, said guiding trough 7 being formed in a support body 8 (see FIGS. 4–10). The guiding trough guides and supports the tape part 2 of the garniture tape 1.

The tape part 2 of the garniture tape 1 supports and transports a paper strip 9 in the usual manner, which paper strip coxes from a reel of cigarette paper not shown. Ahead of the entrance end 5 of the guiding trough 7 tobacco is deposited on the paper strip 9 as indicated by arrow 32 in FIG. 2.

Figure 3:
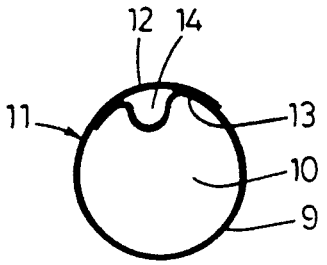
FIG. 3 is a cross-section of the tobacco rod according to line III—III of FIG. 2.

The tobacco 10 is transported through the apparatus together with the paper strip 9, wherein the tobacco is compressed and enclosed by the paper strip 9, so that finally a tobacco rod 11 is delivered at the exit end 6 of the guiding trough 7. As shown in the section of FIG. 3, a first longitudinal edge part 12 is laid over a second longitudinal edge part 13 of the paper strip 9, wherein this second longitudinal edge part 13 is folded into a channel 14 formed in the circumference of the tobacco core 10. The first longitudinal edge part 12 is attached to the longitudinal edge part 13 on both sides of the channel 14 so that a permanent shape stability of the channel 14 is guaranteed.

Figure 4:
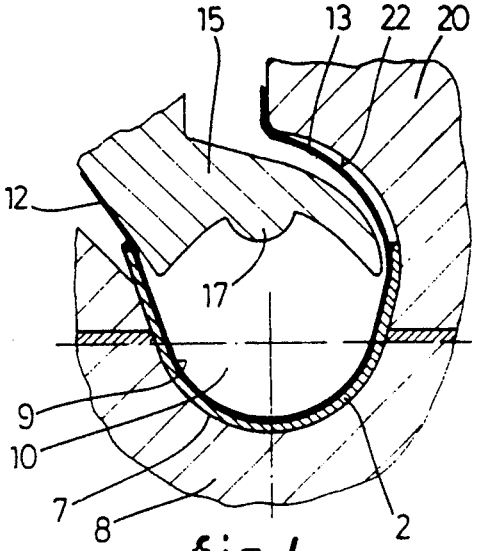
FIGS. 4–10 show different cross-sections of the apparatus of FIGS. 1 and 2 in a larger scale.

As particularly shown in the section according to line IV—IV of FIG. 4, the entrance end 5 of the guiding trough 7 is followed by an entrance finger 15 which is mounted on a carrier 16 at a certain distance above the bottom of the guiding trough 7. The entrance finger 15 compresses the supplied tobacco 10. The entrance finger 15 is provided with a ridge 17 at its side facing the guiding trough 7, which ridge 17 has a substantially semi-cylindrical cross-section for forming the channel 14 in the circumference of the tobacco core 10. Because of the fact that the channel 14 is formed by the entrance finger 15 during compressing the tobacco 10, a uniform density of tobacco is guaranteed along the whole cross-section also directly adjacent the channel 14. At the end of the entrance finger 15 opposite of the entrance end 5 there is further provided a recess 18 corresponding with the ridge 17, said recess 18 cooperating with a folding element 19 by which the second longitudinal edge part 13 of the paper strip 9 is folded into the channel 14. This folding element 19 is carried by a rear guiding wall element 20 extending substantially from the beginning of the entrance finger 15 upto beyond a first glueing means 21. The guiding wall element 20 has a guiding wall 22 for gradually folding the second longitudinal edge part 13 of the paper strip 9 first over the entrance finger 15 and subsequently over the tobacco core 10.

Figure 5:
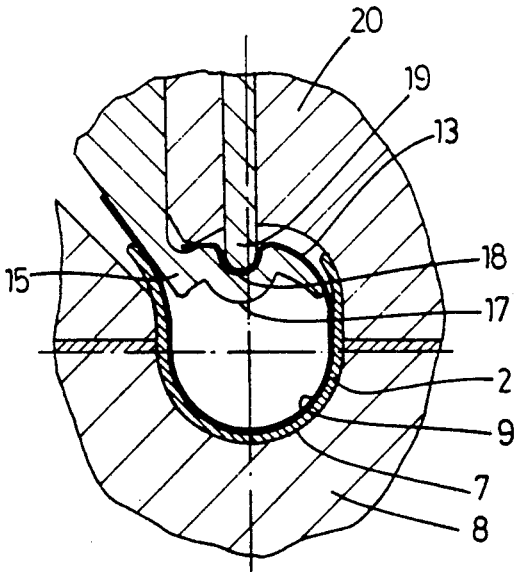
Figure 6:
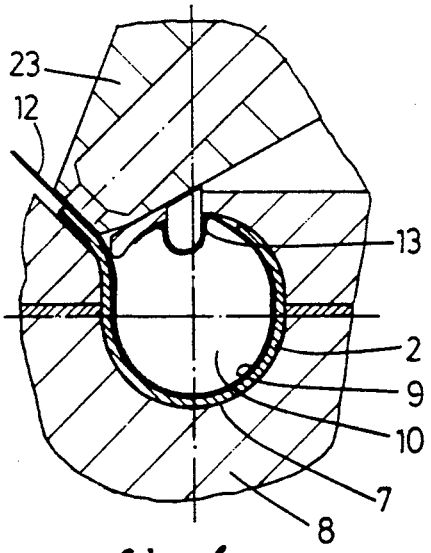
Figure 7:
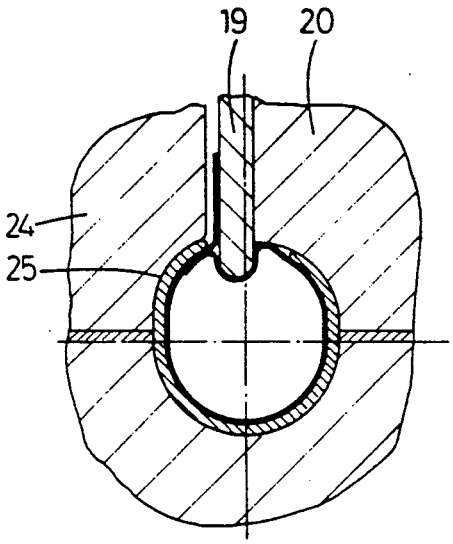

In order to prevent damages to the channel 14 formed by the ridge 17 directly in the tobacco 10 during folding the longitudinal edge part 13 into this channel, the folding element 19 in cooperation with the recess 18 starts to bring the longitudinal edge part 13 in the shape of the channel, as indicated in section V—V in FIG. 5, whereafter the folding element 19 presses the preshaped longitudinal edge part 13 into the channel 14 when leaving the entrance finger 15, as appears from section VI—VI of FIG. 6.

In FIG. 6 there is also shown a second glueing means 23 which applies a glue line on the first longitudinal edge part 12 at a certain distance of its end edge. Substantially at the location of the second glueing means 23 a front guiding wall element or cover chamber 24 starts, said guiding wall element 24 being adapted to fold the first longitudinal edge part 12 of the paper strip 9 over the second longitudinal edge part 23. To this end the guiding wall element 24 has a first guiding wall 25 which presses the glue line applied by the second glueing means, on the end edge of the second longitudinal edge part 13 at one side of the channel 14 as indicated in section VII—VII of FIG. 7.

Figure 8:
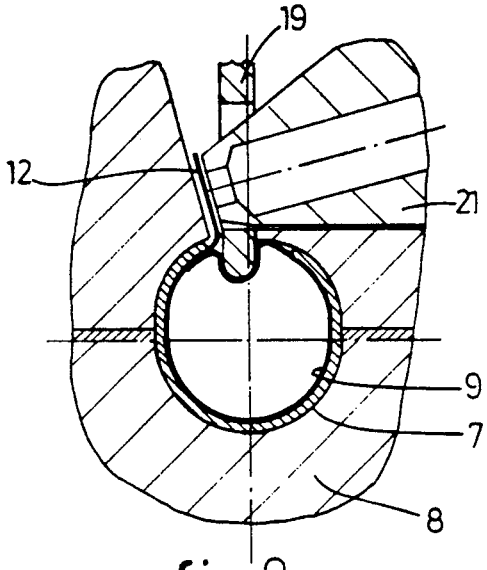

Thereafter the first glueing means 21 applies a glue line on the end edge of this longitudinal edge part 12 (see FIG. 8). The first glueing means 21 is followed by a second guiding wall 26 of the guiding wall element 24, which second guiding wall presses the glue line applied by the first glueing means on the longitudinal edge part 13 at the other side of the channel 14. During this step the end of the folding element 19 extends below the second guiding wall 26. Thereby deformation of the channel during closing the paper strip 9 is prevented. Moreover the second guiding wall 26 is provided with a recess 27 so that at the location of the channel 14 there is some space available below the guiding wall 26 and the channel will not be deformed.

Figure 9:
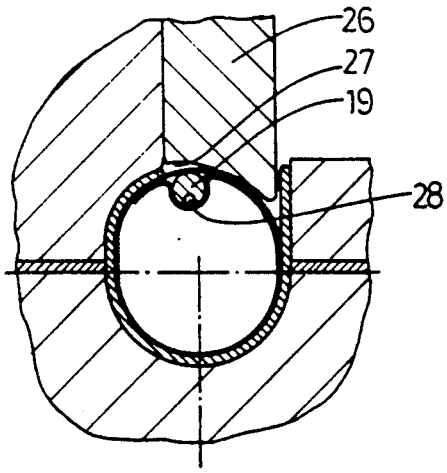

Further it is shown in the section of FIG. 9 that the folding element 19 of the embodiment shown is provided with a groove 28 substantially at the location of the second guiding wall 26, which groove is connected in a manner not shown to a source of compressed air so that an additional shaping of the longitudinal edge part 13 into the desired channel 14 occurs.

Figure 10:
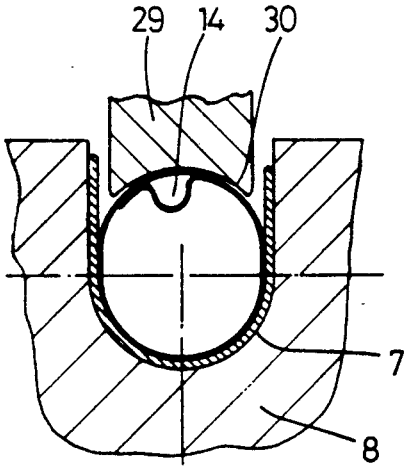

Between the front guiding wall element 24 and the exit end 6 of the guiding trough 7 a heating element (not shown in FIGS. 1 and 2) for the glue lines is provided, a heating beam 29 of which is partially shown in section X—X of FIG. 10. This heating beam 29 has a contact surface 30 which is made concave with a radius which is greater than the radius of the shaped tobacco rod 11, preferably at least 10% greater. Thereby it is achieved that the longitudinal edges of the heating beam 29 will not cause any damage to the paper strip due to the exerted pressure.

As schematically indicated in FIG. 2 there are provided exhaust openings 31 in the rear guiding wall element 20 at the location of the entrance finger 15 for exhausting of tobacco particles and the like which could be above the entrance finger. Such tobacco particles would otherwise interfere the accurate shaping of the longitudinal edge part 13 of the paper strip 9.

The invention is not restricted to the above-described embodiment which can be varied in a number of ways within the scope of the following claims.

I claim:

1. Method for manufacturing a rod of a material to be smoked enclosed by a paper strip, wherein a paper strip is supported and transported by a garniture tape and the material to be smoked is deposited on the paper strip, wherein the material to be smoked is compressed into a material core and a channel is formed in the material core, said paper strip having first and second longitudinal edge parts and being closed with its longitudinal edge parts around the compressed material core, wherein the channel is formed in the circumference of the rod during said compressing, wherein the second longitudinal edge part of the paper strip is folded into the channel and the first longitudinal edge part is subsequently laid over said channel.

2. Method according to claim 1, wherein the second longitudinal edge part is brought into the shape of said channel before it is folded into said channel.

3. Method according to claim 1, wherein the first longitudinal edge part of the paper strip is attached to the second longitudinal edge part at both sides of said channel, and a folding element protrudes in the formed channel during said attaching.

4. Method according to claim 3, wherein compressed air is blown into the channel through said folding element.

5. Apparatus for manufacturing a rod of a material to be smoked enclosed by a paper strip, comprising an endless garniture tape with a tape part for supporting the paper strip, a supporting body with a guiding trough for guiding said tape part of the garniture tape, said guiding trough having a mainly semi-cylindrical cross-section and an entrance end and exit end, respectively, an entrance finger located near the entrance end of the guiding trough for compressing the material to be smoked, a first gluing means for applying a glue line on the end edge of a first longitudinal edge part of said paper strip and means for closing the paper strip around the compressed material core, wherein said entrance finger is provided with a ridge for forming a channel in the circumference of the material core, and said closing means includes a folding element for folding a second longitudinal edge part on the paper strip into said channel.

6. Apparatus according to claim 5, wherein the closing means includes a rear guiding wall element extending from the beginning of the entrance finger up to beyond the first glueing means for folding the second longitudinal edge part of the paper strip over the entrance finger and the material core, wherein the entrance finger has a recess corresponding with said ridge, at its end opposite of the entrance end of the guiding trough, wherein the folding element carried by said rear guiding wall element projects into said recess and extends from said recess up to beyond the entrance finger in such a manner that the longi- tudinal edge part of the paper strip folded in said recess is forced into said channel.

7. Apparatus according to claim 6, wherein a second glueing means is located between the first glueing means and the entrance finger for applying a glue line at a predetermined distance from the end edge of the first longitudinal edge part on this edge part of the paper strip.

8. Apparatus according to claim 7, wherein the closing means includes a front guiding wall element for folding the first longitudinal edge part of the paper strip over the second longitudinal edge part, wherein said front guiding wall element has a first guiding wall which presses the glue line applied by the second glueing means on the second longitudinal edge part at one side of the channel, and a second guiding wall which follows the first guiding wall and which presses the glue line applied by the first glueing means on the second longitudinal edge part at the other side of the channel, wherein the folding element extends with a freely projecting end up to below the second guiding wall.

9. Apparatus according to claim 8, wherein the folding element, substantially at its end lying below the second guiding wall, is provided with an open groove connectable to a source of compressed air.

10. Apparatus according to claim 8, wherein a recess is provided in the second guiding wall at the location of the channel.

11. Apparatus according to claim 6, wherein exhaust openings are provided in the rear guiding wall above the end of the entrance finger provided with said recess.

12. Apparatus according to claim 8, wherein a heating element for the glue lines is provided in the direction of movement of the garniture tape past the first guiding wall element, said heating element having a contact surface which is made concave with a radius which is at least 10% longer than the radius of the rod.

13. Cigarette comprising a rod obtained from a rod manufactured according to the method of claim 1, wherein a channel is provided at the circumference, wherein one longitudinal edge part of the paper strip is folded into the channel and the other longitudinal edge part extends over this channel and is attached to said one longitudinal edge part on both sides of said channel.

14. Method according to claim 1 wherein said material to be smoked is tobacco.

15. Apparatus according to claim 5 wherein said material to be smoked is tobacco.

* * * * *